US011017936B2

(12) United States Patent
Kim et al.

(10) Patent No.: US 11,017,936 B2
(45) Date of Patent: May 25, 2021

(54) COIL ELECTRONIC COMPONENT

(71) Applicant: SAMSUNG ELECTRO-MECHANICS CO., LTD., Suwon-si (KR)

(72) Inventors: Ye Jeong Kim, Suwon-si (KR); Ki Seok Kim, Suwon-si (KR); Myung Sam Kang, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 485 days.

(21) Appl. No.: 15/650,309

(22) Filed: Jul. 14, 2017

(65) Prior Publication Data

US 2018/0122548 A1 May 3, 2018

(30) Foreign Application Priority Data

Oct. 27, 2016 (KR) ..... 10-2016-0141313

(51) Int. Cl.

| | |
|---|---|
| ***H01F 17/04*** | (2006.01) |
| ***H01F 27/24*** | (2006.01) |
| ***H01F 17/00*** | (2006.01) |
| ***H01F 5/04*** | (2006.01) |
| ***H01F 5/06*** | (2006.01) |
| ***H01F 27/29*** | (2006.01) |
| ***H01F 27/32*** | (2006.01) |
| *H01F 41/10* | (2006.01) |
| *H01F 27/28* | (2006.01) |

(52) U.S. Cl.

CPC ..... *H01F 27/24* (2013.01); *H01F 5/04* (2013.01); *H01F 5/06* (2013.01); *H01F 17/0013* (2013.01); *H01F 17/0033* (2013.01); *H01F 17/04* (2013.01); *H01F 27/292* (2013.01); *H01F 27/323* (2013.01); *H01F 41/10* (2013.01); *H01F 2017/004* (2013.01); *H01F 2027/2809* (2013.01)

(58) Field of Classification Search

USPC ..... 336/221, 200, 232, 192

See application file for complete search history.

(56) References Cited

U.S. PATENT DOCUMENTS

2010/0157565 A1* 6/2010 Yoshida ..... H01F 27/292 361/811

2012/0112869 A1* 5/2012 Nishikawa ..... H01F 17/0013 336/200

(Continued)

FOREIGN PATENT DOCUMENTS

JP 2006-332147 A 12/2006

KR 10-2016-0019266 A 2/2016

*Primary Examiner* — Shawki S Ismail

*Assistant Examiner* — Kazi S Hossain

(74) *Attorney, Agent, or Firm* — Morgan, Lewis & Bockius LLP

(57) ABSTRACT

A coil electronic component includes a plurality of coil layers including coil patterns and connection patterns. The coil patterns are disposed between the connection patterns. The connection patterns are at least partially exposed from the coil electronic component. The coil electronic component further includes connection electrodes connecting the connection patterns formed in different coil layers of the plurality of coil layers with each other, and external electrodes connected to the connection electrodes and at least partially enclosing the connection electrodes.

20 Claims, 14 Drawing Sheets

(56) References Cited

U.S. PATENT DOCUMENTS

| | | | | |
|---|---|---|---|---|
| 2015/0136463 | A1* | 5/2015 | Lee | H01G 4/005 174/260 |
| 2016/0042857 | A1* | 2/2016 | Chun | H01F 17/0013 336/200 |
| 2016/0343489 | A1* | 11/2016 | Horikawa | H01F 17/0013 |
| 2017/0098506 | A1* | 4/2017 | Ando | H01G 4/232 |
| 2017/0154729 | A1* | 6/2017 | Lee | H01G 4/012 |
| 2017/0178798 | A1* | 6/2017 | Yoon | H01F 27/292 |

* cited by examiner

COIL ELECTRONIC COMPONENT

CROSS-REFERENCE TO RELATED APPLICATION

This application claims priority under 35 U.S.C. § 119 to Korean Patent Application No. 10-2016-0141313 filed on Oct. 27, 2016, in the Korean Intellectual Property Office (KIPO), the disclosure of which is incorporated herein by reference in its entirety.

BACKGROUND

1. Field

The present disclosure relates to a coil electronic component.

2. Description of Related Art

A coil electronic component, e.g., an inductor, is formed by winding coils around a ferrite core or printing the coils on the ferrite core and forming electrodes on both end surfaces of the core. The inductor, together with a resistor and a capacitor, may constitute an electronic circuit that may be used to remove noise or used as a component constituting an LC resonant circuit. An inductor may be classified as a multilayer inductor, a winding type inductor, a thin film type inductor, or the like, depending on a form of the coil.

In general, an inductor includes is formed by coils embedded in a body formed of an insulating material. Recent advances in fabrication technology have resulted high efficiency products having miniaturized circuit elements having improved electrical characteristics and diverse functions. However, in the inductor according to the related art, an external electrode needs to be formed at a low temperature in order to prevent a metal from being oxidized and melted. To this end, a method of hardening a resin electrode containing a resin and Ag, or the like, has been used. By using a resin electrode, electrical resistance increases and electrical characteristics of the inductor may be deteriorated.

SUMMARY

An aspect of the present disclosure may provide a coil electronic component having improved electrical characteristics including, for example, a direct current (DC) resistance. Another aspect of the present disclosure may provide a method of manufacturing the coil electronic component.

According to an aspect of the present disclosure, a coil electronic component may include a plurality of coil layers including coil patterns and connection patterns, the coil patterns disposed between the connection patterns, and the connection patterns being at least partially exposed from the coil electronic component, connection electrodes connecting the connection patterns formed in the different coil layers of the plurality of coil layers with each other, and external electrodes connected to the connection electrodes and at least partially enclosing the connection electrodes.

The plurality of coil layers may include at least two connection patterns.

A coil pattern of an uppermost coil layer of the plurality of coil layers and a coil pattern of a lowermost coil layer of the plurality of coil layers may be connected to one of the at least two connection patterns.

The external electrodes may include first and second external electrodes having opposite polarities, and a connection pattern of the uppermost coil layer may be connected to the first external electrode and a connection pattern of the lowermost coil layer may be connected to the second external electrode.

The plurality of coil layers includes at least intermediate coil layer disposed between the uppermost coil layer and the lowermost coil layer, and a coil pattern of the intermediate coil layer and the connection patterns are disconnected.

The at least two connection patterns may be disposed opposite each other.

The connection electrodes may at least partially cover side surfaces of the connection patterns.

The connection electrodes may be pre-plating patterns.

The connection electrodes are conductive vias disposed between the connection patterns formed on the different layers.

The external electrodes may directly contact the connection patterns.

The coil electronic component may further include flexible electrodes on upper and lower portions of the connection electrodes and covered by the external electrodes.

The flexible electrodes may include at least one of an insulating resin and conductive particles.

The coil electronic component may further include insulating layers at least partially enclosing the coil patterns and the connection patterns.

The coil electronic component may further include a core part in a through hole defined in the insulating layers, the core part including a magnetic material.

The core part may at least partially upper and lower portions of the plurality of coil layers.

The coil electronic component may further include conductive vias connecting the coil patterns on different layers with each other.

Each external electrode may include a multilayer structure.

The multilayer structure of each external electrode may include a plurality of plating layers.

BRIEF DESCRIPTION OF DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Hereinafter, exemplary embodiments of the present disclosure will be described in detail with reference to the accompanying drawings.

Figure 1:
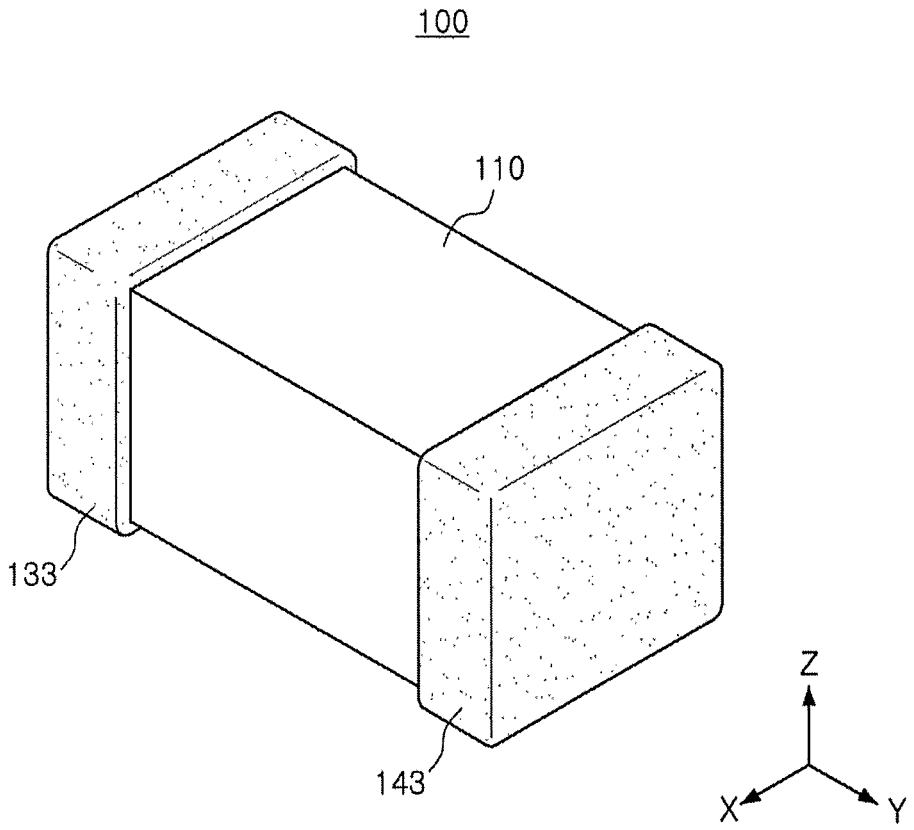
FIG. 1 is a schematic perspective view of a coil electronic component according to an exemplary embodiment in the present disclosure.
Figure 2:
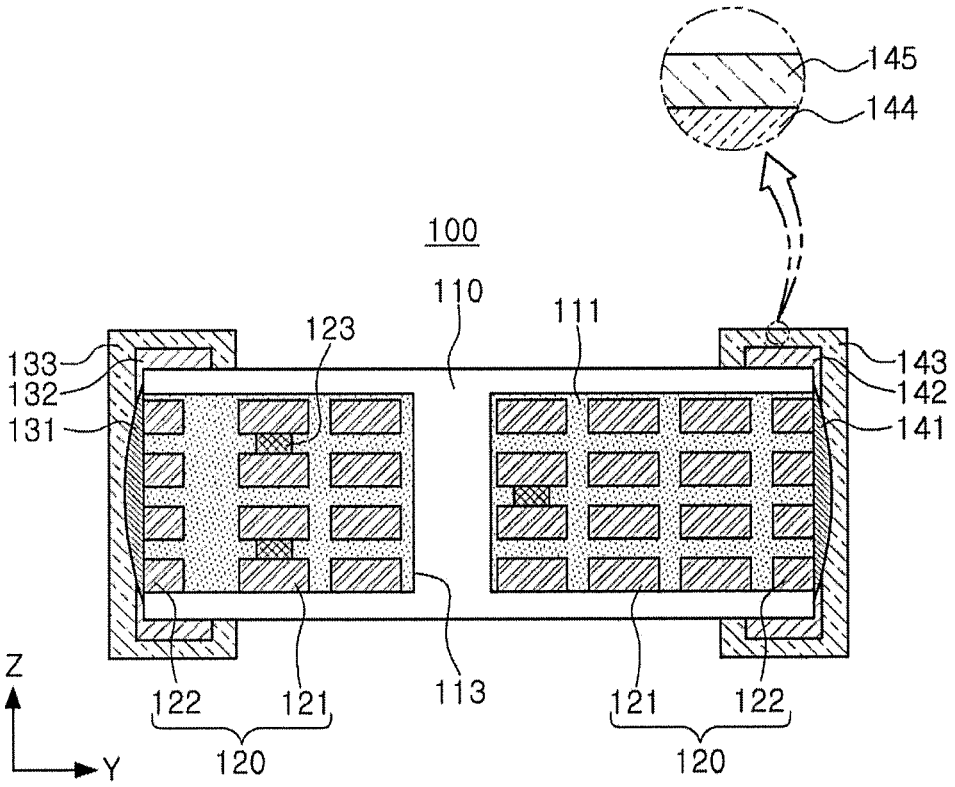
FIG. 2 is a cross-sectional view of the coil electronic component of FIG. 1 illustrating coil patterns, connection patterns, and conductive vias.
Figure 3:
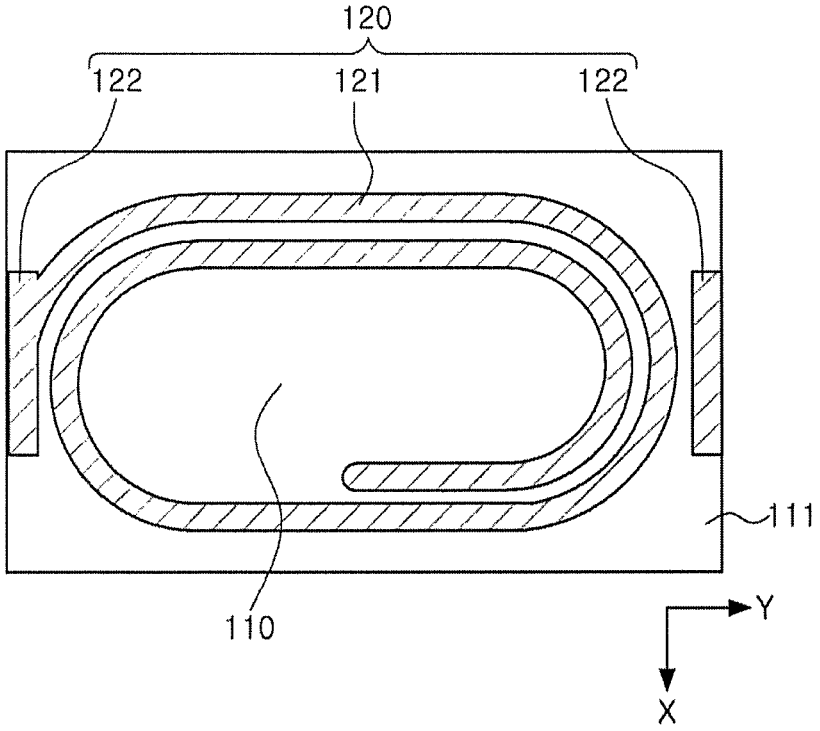
FIG. 3 illustrates an uppermost coil layer of the coil electronic component of FIG. 1.
Figure 4:
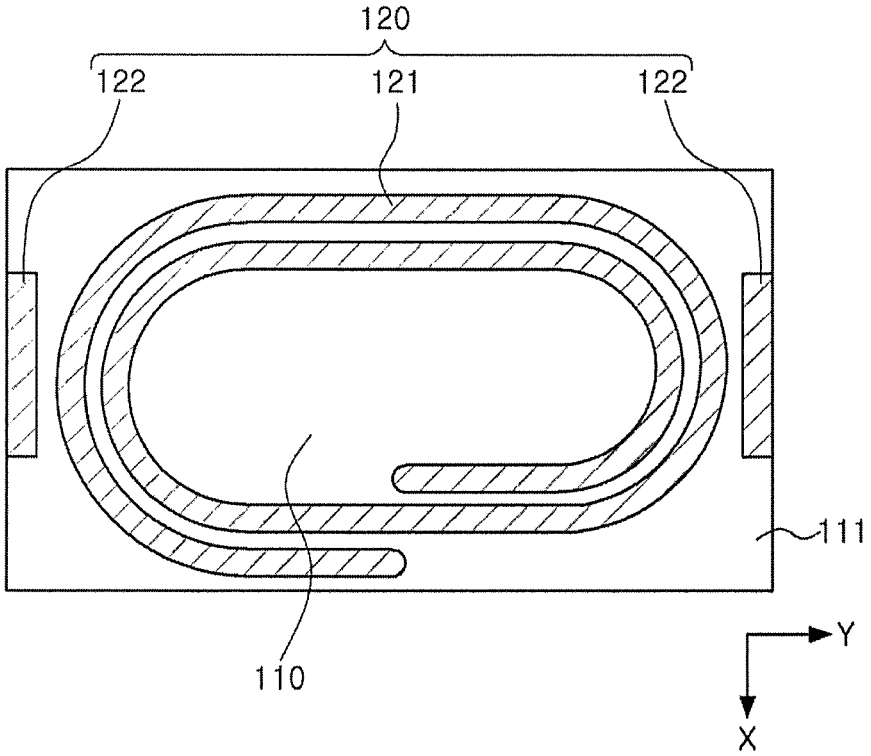
FIG. 4 illustrates an intermediate coil layer of the coil electronic component of FIG. 1.
Figure 5:
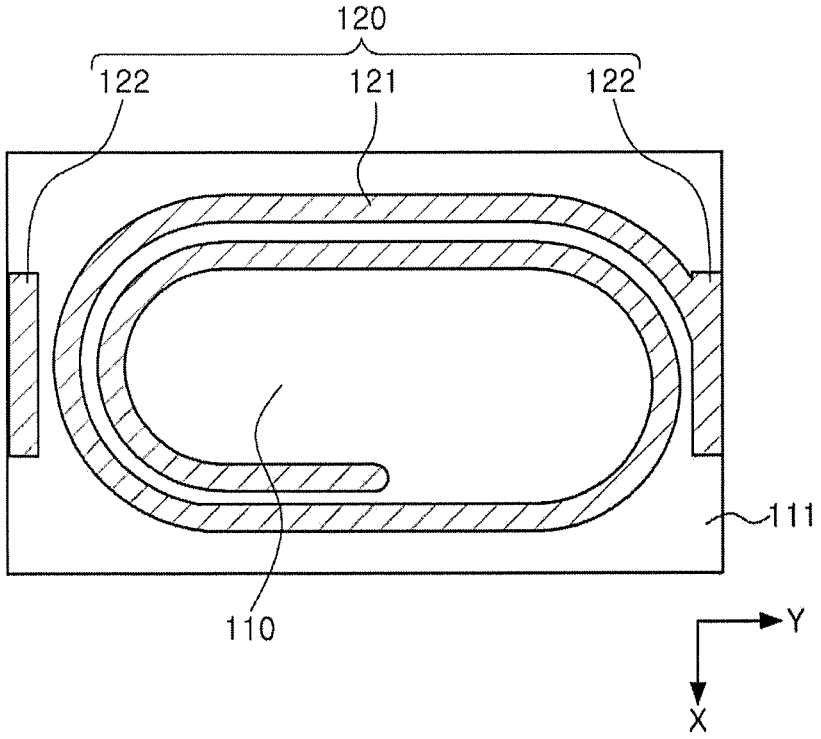
FIG. 5 illustrates a lowermost coil layer of the coil electronic component of FIG. 1.

FIG. 1 is a schematic perspective view of a coil electronic component 100 according to an exemplary embodiment in the present disclosure. FIG. 2 is a cross-sectional view of the coil electronic component 100 of FIG. 1 in the Z-Y plane illustrating the coil patterns, connection patterns, and conductive vias. FIGS. 3 through 5 are plan views in the X-Y plane illustrating the coil layers of the coil electronic component 100 of FIG. 1.

First, referring to FIGS. 1 and 2, the coil electronic component 100 may include a plurality of coil layers 120 disposed in different layers in the vertical (Z) direction, connection electrodes 131 and 141, and external electrodes 133 and 143. The respective components of the coil electronic component 100 will hereinafter be described.

The plurality of coil layers 120 may include coil patterns 121 and connection patterns 122 disposed at or adjacent the longitudinally (Y-Y axis) outer end surfaces of the coil electronic component 100 and including the coil patterns 121 therebetween. The connection patterns 122 may be externally exposed from the longitudinally outer end surfaces. Insulating layers 111 may at least partially cover or otherwise enclose the coil patterns 121 and the connection patterns 122. Any desired material selected from among materials that may be used as a material of one component forming a body of an inductor may be used as a material of the insulating layer 111. For example, a resin, ceramic, ferrite, a combination thereof, and the like, may be used as the material of the insulating layer 111. In the present exemplary embodiment, a photosensitive insulating material may be used as the material of the insulating layer 111. Therefore, relatively thinner patterns may be implemented via a photolithography process. For instance, the insulating layer 111 may be formed of the photosensitive insulating material, and conductive vias 123, the coil patterns 121, the connection patterns 122, and the like, having a very small thickness (e.g., micron level) may be formed and the coil electronic component 100 may be miniaturized and performance thereof may be improved. For example, a photosensitive organic material or a photosensitive resin may be included in the insulating layer 111. In addition, an inorganic component such as $SiO_2/Al_2O_3/BaSO_4$/Talc, or the like, may further in included as a filler component the insulating layer 111.

The coil patterns 121 may form a coil type structure in a stacking direction (Z-direction) of the coil layers 120 as illustrated in FIGS. 3 through 5. In this case, as illustrated in FIG. 2, the coil patterns 121 formed on different layers may be connected to each other through the conductive vias 123. FIG. 2 illustrates the coil electronic component 100 including four coil layers 120, however, embodiments are not limited thereto and the number of coil layers 120 included in the coil electronic component 100 may be greater than or less than four.

The connection patterns 122 may be disposed between the coil patterns 121 and the external electrodes 133 and 143 and such an arrangement may permit stable electrical connection between the coil patterns 121 and the external electrodes 133 and 143. The connection patterns 122 on the respective coil layers 120 may be formed on different layers and may be connected to each other by the connection electrodes 131 and 141.

The coil patterns 121 and the connection patterns 122 may be formed by patterning a metal having high conductivity, and using, for example, a tenting process using copper (Cu) foil etching, a semi-additive process (SAP) using copper plating, a modified semi-additive process (MSAP), a combination thereof, and the like. The coil patterns 121 and the connection patterns 122 may be or include copper (Cu), silver (Ag), palladium (Pd), aluminum (Al), nickel (Ni), titanium (Ti), gold (Au), platinum (Pt), a mixtures thereof, and the like. The coil patterns 121 and the connection patterns 122 may also be formed by a process such as plating, sputtering, or the like, in addition to patterning method.

The conductive vias 123 may connect the coil patterns 121 disposed on different layers to each other. The conductive via 123 may be formed of a plurality of plating layers, and may have, for example, a stacking structure including a Cu layer and an Sn layer. An intermetallic compound may be formed at an interface between the conductive via 123 and the coil pattern 121. In an embodiment using printed circuit board (PCB) technology, a conductive via may be formed of the same metal as that of a circuit pattern. Therefore, an intermetallic compound may be absent. In the embodiment using a collective stacking method as described below, a material forming the coil pattern 121 and a material (e.g., Sn) forming the conductive via 123 may be diffusion-bonded to each other, such that the coil pattern 121 and the conductive via 123 may be electrically connected to each other. However, the conductive via 123 is not limited to being formed in a multilayer structure as in the present exemplary embodiment, but, in other embodiments, may be formed as a single layer structure.

The coil layers 120 of the coil electronic component 100 will be described in more detail with reference to FIGS. 3 through 5. Each coil layer 120 may include a pair of connection patterns 122 for connecting the coil layer 120 to the external electrodes 133 and 143 (FIGS. 1 and 2). In this case, the pair of connection patterns 122 may be disposed at longitudinally (Y-Y direction) opposite ends of the coil electronic component 100.

Coil patterns 121 of the uppermost coil layer and the lowermost coil layer of the plurality of coil layers 120 may be connected to one of a pair of connection patterns 122. For the purposes of discussion, uppermost and lowermost are with reference to the Z-direction in FIGS. 1 and 2. For the sake of brevity, the external electrodes 133 and 143 are omitted in FIGS. 3-5. FIG. 3 illustrates the uppermost coil layer, and FIG. 5 illustrates the lowermost coil layer. The external electrodes 133 and 143 (FIGS. 1-2) may include a first external electrode 133 and a second external electrode 143 having opposite polarities from each other. The connection pattern 122 (left portion of FIG. 3) of the uppermost coil layer of the plurality of coil layers 120 may be connected to the first external electrode 133, and a connection pattern 122 (right portion of FIG. 5) of the lowermost coil layer of the plurality of coil layers 120 may be connected to the second external electrode 143. As a result of this configuration, a coil structure may be formed by the plurality of coil layers 120 between the first and second external electrodes 133 and 143.

The coil patterns 121 of intermediate coil layers 120 disposed between the uppermost coil layer and the lowermost coil layer may not be connected to the connection patterns 122, and a structure of such intermediate coil layers 120 is illustrated in FIG. 4. Even though the connection patterns 122 of the intermediate coil layers 120 are not connected to the coil patterns 121, one of the two connection patterns 122 of the intermediate coil layers 120 may be connected to the first external electrode 133, and the other of the two connection patterns 122 may be connected to the second external electrode 143, as illustrated in FIG. 2. Because of this configuration, direct current (DC) resistance characteristics between the coil patterns 121 and the external electrodes 133 and 143 may be improved.

Referring to FIG. 2, the first connection electrode 131 and the second connection electrode 141 may connect the connection patterns 122 formed on different layers to each other. The first connection electrode 131 is electrically connected to the first external electrode 133 and the second connection electrode 141 is electrically connected to the second external electrode 143. As illustrated in FIG. 2, the connection electrodes 131 and 141 may cover the longitudinally opposite side surfaces of the connection patterns 122. In an example, the connection electrodes 131 and 141 may be pre-plating patterns. The connection electrodes 131 and 141 may be formed in a pre-plating pattern form to more effectively connect the connection patterns 122 disposed on different layers with each other and thereby improve DC resistance characteristics, compared to the prior art method of using a resin electrode, or similar.

As described above, a pair of external electrodes 133 and 143 may be disposed opposite each other. The external electrodes 133 and 143 may each have a multilayer structure. In more detail, the external electrode 143 may include two (or more) plating layers 144 and 145. For example, a first plating layer 144 may be a nickel (Ni) plating layer, and a second layer 145 may be a tin (Sn) plating layer. The external electrode 133 may similarly include at least two plating layers.

Flexible (malleable or otherwise bendable) electrodes 132 and 142 may be formed on upper and lower portions of the connection electrodes 131 and 141, respectively. The flexible electrodes 132 and 142 may be covered by the external electrodes 133 and 143, respectively. The flexible electrodes 132 and 142 may alleviate or otherwise minimize external impacts, shocks, stresses, or the like, acting on the coil electronic component 100. The flexible electrodes 132 and 142 may have, for example, a structure including an insulating resin and conductive particles. As illustrated, the flexible electrodes 132 and 142 are disposed along the upper and lower edges (or corners) of the coil electronic component 100. The flexible electrodes 132 and 142 may be disposed on the upper and lower surfaces of the coil electronic component 100 and may extend to the longitudinally opposite (Y-Y direction) end surfaces of the coil electronic component 100. The flexible electrodes 132 and 142 may not be formed in the regions where the connection patterns 122 are connected to the connection electrodes 131 and 141. As a result, the coil electronic component 100 may have improved electrical characteristics since the flexible electrodes 132 and 142 have a relatively high electrical resistance.

Referring to FIGS. 1-5, the coil electronic component 100 according to the present exemplary embodiment may further include a core part 110. The core part 110 may be formed by filling a hole 113 that may penetrate through the insulating layers 111 with a magnetic material, or the like, as illustrated in FIG. 2. The core part 110 may improve the magnetic characteristics of the coil electronic component 100. The core part 110 may extend from an upper portion to a lower portion of the coil electronic component 100 and may cover the upper and lower portions of the plurality of coil layers 120, as illustrated in FIG. 2.

An example of a method of manufacturing the coil electronic component 100 will hereinafter be described with reference to FIGS. 6 through 11.

As described above, the coil electronic component 100 described above may be manufactured by collectively stacking a plurality of unit laminates. As an example, FIGS. 6 through 8 illustrate manufacture of a unit laminate including insulating layers 111, coil patterns 121, connection patterns 122, conductive vias 123.

Figure 6:
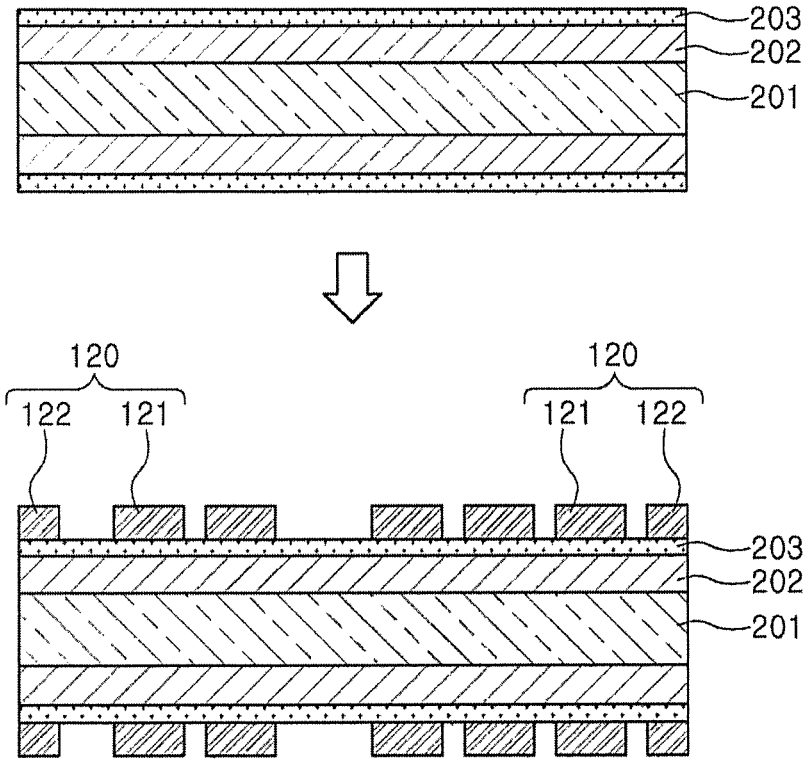
FIGS. 6-11 illustrate the different processing steps included in a method of manufacturing a coil electronic component according embodiments disclosed.

As illustrated in FIG. 6, a carrier layer 201 may be prepared, and a coil layer 120 may be formed on a surface of the carrier layer 201. The carrier layer 201 and may include a thermosetting resin and may be in a form of a copper clad laminate having copper foil layers 202 and 203 formed on a surface of the carrier layer 201. The copper foil layers 202 and 203 may function as seed layers for forming the coil patterns 121 and the connection patterns 122. The connection patterns 122 may be formed together with the coil patterns 121 while forming the coil patterns 121. The copper foil layers 202 and 203 may facilitate easy separation of the carrier layer 201 in a subsequent process. However in other embodiments, the copper foil layers 202 and 203 may be omitted.

The coil patterns 121 and the connection patterns 122 may be obtained by positioning a mask layer on the copper foil layer 203, patterning the mask layer, and then plating Cu, or the like. Then, the mask layer may be removed. In addition, as illustrated in FIG. 6, the coil patterns 121 and the connection patterns 122 may be formed on both of upper and lower surfaces of the carrier layer 201. Therefore, two unit laminates may be obtained by a single process.

Figure 7:
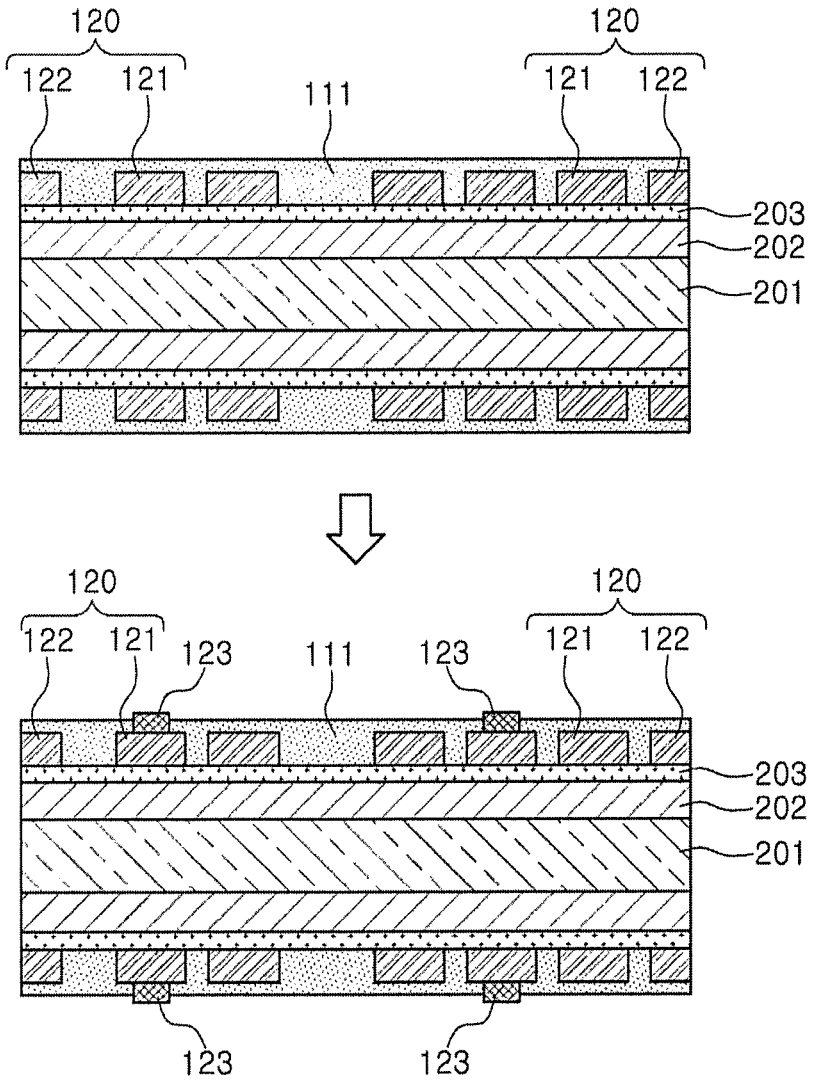
Figure 8:
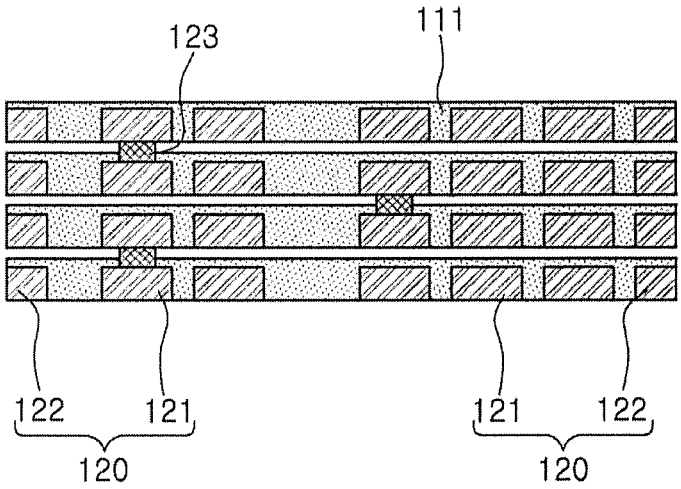

Then, as illustrated in FIG. 7, the coil patterns 121 and the connection patterns 122 may be enclosed by the insulating layers 111. The insulating layers 111 may be formed on both of the upper and lower surfaces of the carrier layer 201. In an example, the insulating layer 111 may be formed of a photosensitive insulating material, and may be applied using a vacuum laminator. The insulating layer 111 may have a thickness of about 10 to 80 μm, and may include a metal or a ceramic filler. In addition, a hardening level of the insulating layer 111 may be adjusted by an amount of the photosensitive material included in the insulating layer 111, and the insulating layer may be formed of a mixture of two (or more) kinds of materials such as a mixture of a thermosetting material and a photosensitive material.

Then, the conductive vias 123 connected to the coil patterns 121 may be formed. In forming the conductive vias 123, the insulating layers 111 formed of the photosensitive insulating material may be exposed and developed using ultraviolet (UV) light, or the like, to form through-holes, and materials, such as a Cu layer and an Sn layer, for forming the conductive vias 123 may be plated to fill the through-holes to form the conductive vias 123 in a multilayer structure.

Then, the carrier layer 201 may be separated from the unit laminate including the insulating layers 111, the coil layers 120, and the conductive vias 123 obtained by the above-mentioned processes. FIG. 8 illustrates four unit laminates stacked aligned with one another. In this case, when the copper foil layers 202 and 203 remain on the insulating layers 111, and the coil layers 120, the remaining copper foil layers 202 and 203 may be removed by an etching process. As described above, a plurality of unit laminates may be collectively stacked as illustrated in FIG. 8. In this case, a stacking structure may be obtained by applying heat and pressure to the plurality of unit laminates. In the stacking structure obtained as described above, interlayer coupling may be implemented without performing a firing process.

As in the present exemplary embodiment, the unit laminates manufactured in advance may be stacked simultaneously to form a body, resulting in a reduction in the number of processes and a process time and costs, compared to a method of sequentially stacking the respective layers. In addition, the method of manufacturing the coil electronic component 100 according to the present exemplary embodiment may be advantageous in effectively implementing specifications such as a size of the coil electronic component 100, electrical characteristics, and the like, by appropriately adjusting the number or thicknesses of coil layers 120. The plurality of unit laminates are stacked simultaneously in the present exemplary embodiment, but the plurality of unit laminates may also be stacked sequentially depending on the number of unit laminates.

Figure 9:
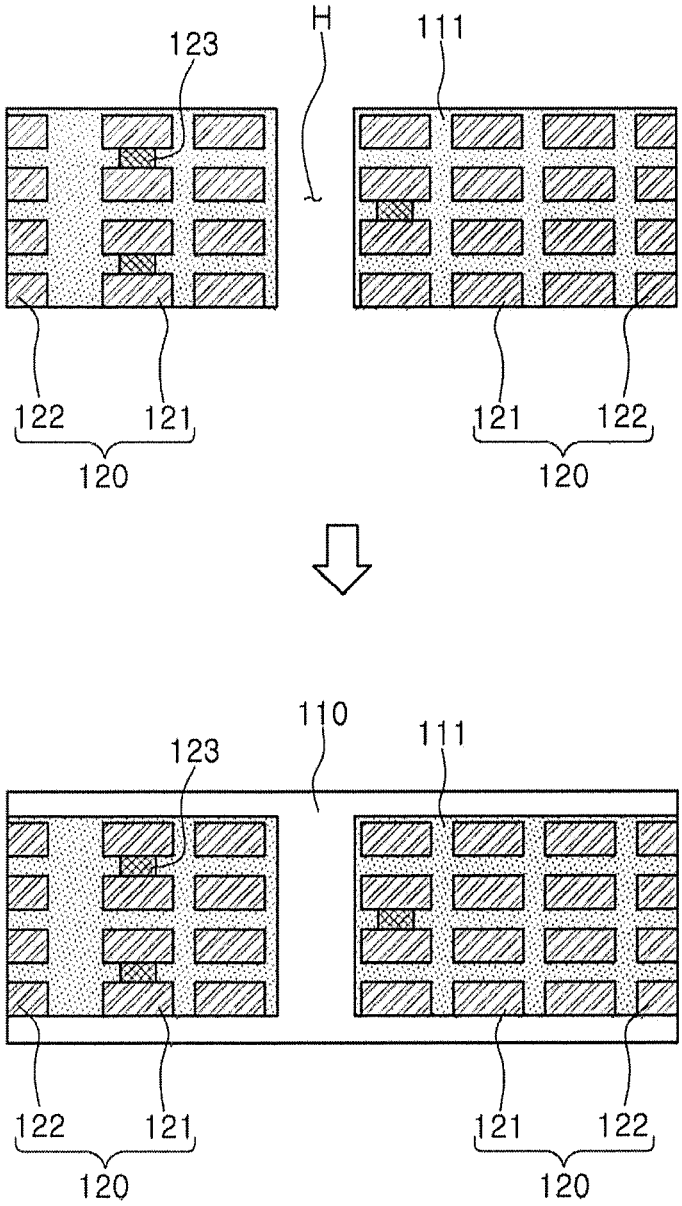

Then, as illustrated in FIG. 9, a hole H may be formed in the insulating layers 111, and may be filled with a magnetic material, or the like, to form a core part 110. The core part 110 may be formed by any process known in the art and a discussion thereof is omitted herein for the sake of brevity.

Figure 10:
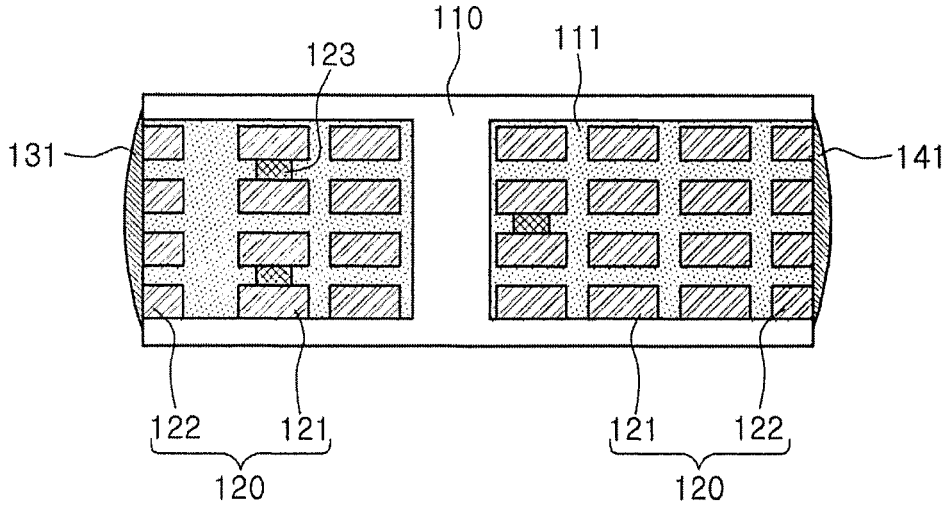

As illustrated in FIG. 10, connection electrodes 131 and 141 connected to the connection patterns 122 of the coil layer 120 may be formed. The connection electrodes 131 and 141 may be obtained by pre-plating a material such as copper (Cu), or the like, to cover the longitudinally opposite side surfaces of the connection patterns 122.

Figure 11:
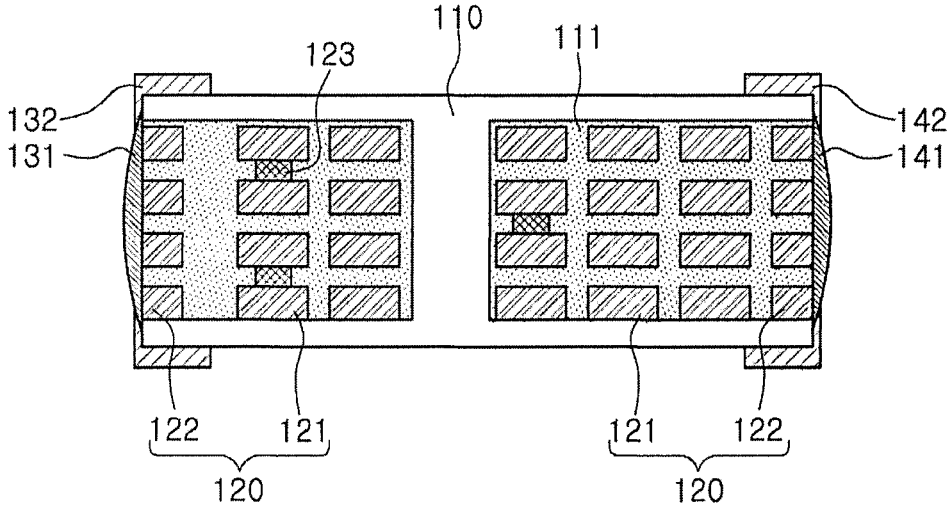

As illustrated in FIG. 11, flexible electrodes 132 and 142 may be formed on upper and lower portions of the connection electrodes 131 and 141, respectively. The flexible electrodes 132 and 142 may be formed by, for example, applying an insulating resin in which conductive particles are dispersed to the insulating layers 111, and the like, and then hardening the insulating resin. The flexible electrodes 132 and 142 may be formed by any process known in the art and a discussion thereof is omitted herein for the sake of brevity.

Then, external electrodes 133 and 143 may be formed at least partially enclosing or covering the connection electrodes 131 and 141, respectively, and the coil electronic component 100 illustrated in FIG. 2 may be obtained. Here, the external electrodes 133 and 143 may be formed by applying a conductive paste or using a plating process, or the like.

FIGS. 12 through 15 are views illustrating a method of manufacturing a coil electronic component according to another exemplary embodiment in the present disclosure and a coil electronic component obtained by such a method of manufacturing.

Figure 12:
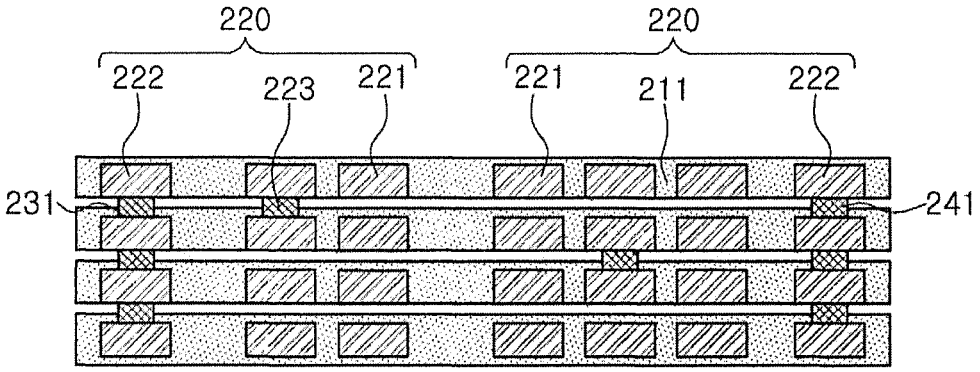
FIGS. 12-15 illustrate the different processing steps included in a method of manufacturing a coil electronic component according to other embodiments disclosed and a coil electronic component obtained therefrom.

The exemplary embodiment differs from the embodiments disclosed above in the structure of the connection electrodes. FIG. 12 illustrates a unit laminate obtained using the processes described above.

Referring to FIG. 12, the unit laminate may include insulating layers 211, coil layers 220, and conductive vias 223, and the coil layers 220 may include coil patterns 221 and connection patterns 222. In the present exemplary embodiment, connection electrodes 231 and 241 may be provided as conductive vias formed between the connection patterns 222 on different layers. The connection electrodes 231 and 241 may be or include the same material as that of the conductive vias 223 connecting the coil patterns 221 to each other and may be formed by the same process as a process of forming the conductive vias 223.

Figure 13:
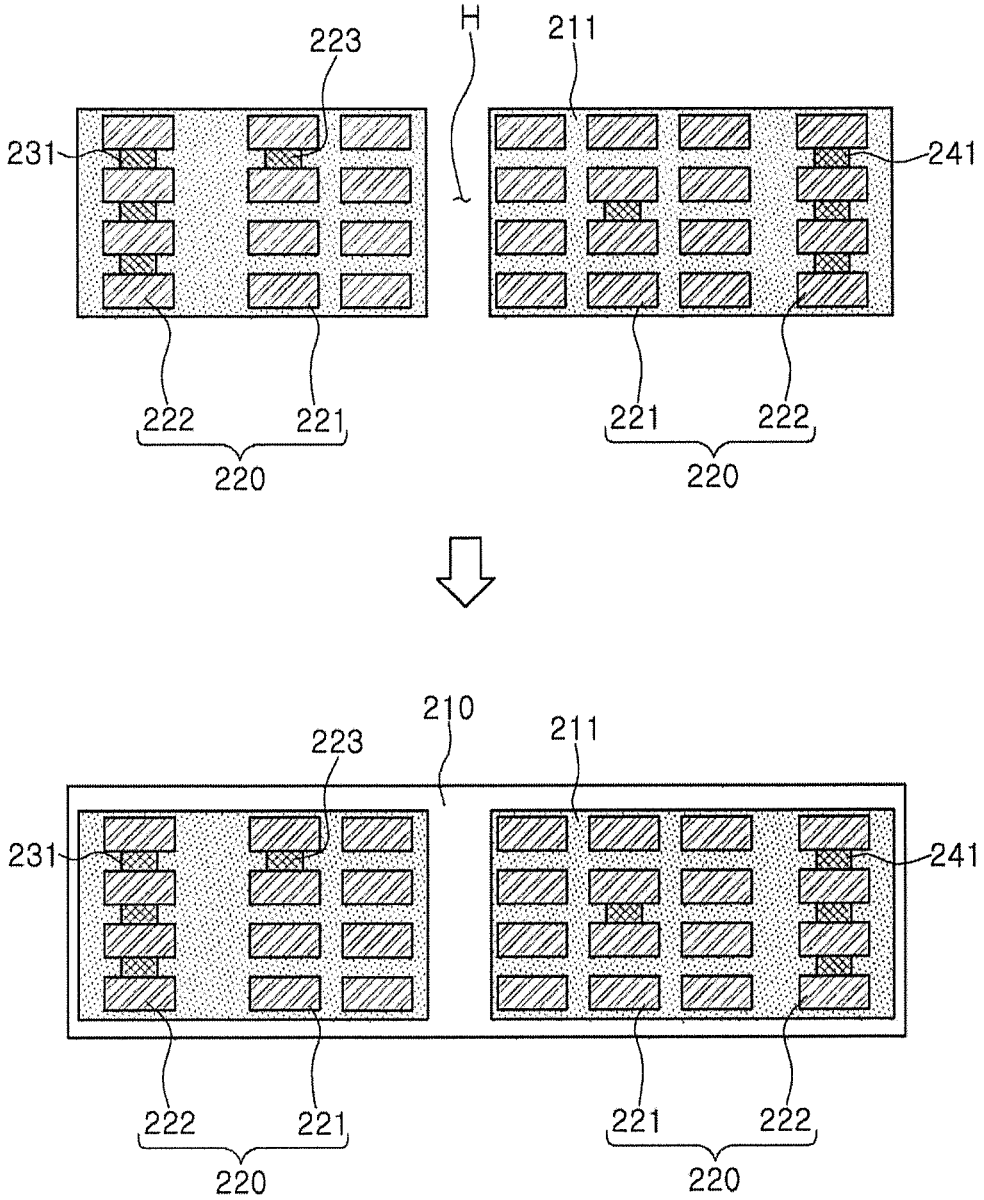

As illustrated in FIG. 13, a hole H may be formed in the insulating layers 211, and may be filled with a magnetic material, or the like, to form a core part 210. In this case, the core part 210 may be not only formed in the hole H, but also be formed to cover upper and lower portions and side surfaces of the insulating layers 211. The core part 210 may be formed by any process known in the art and a discussion thereof is omitted herein for the sake of brevity.

Figure 14:
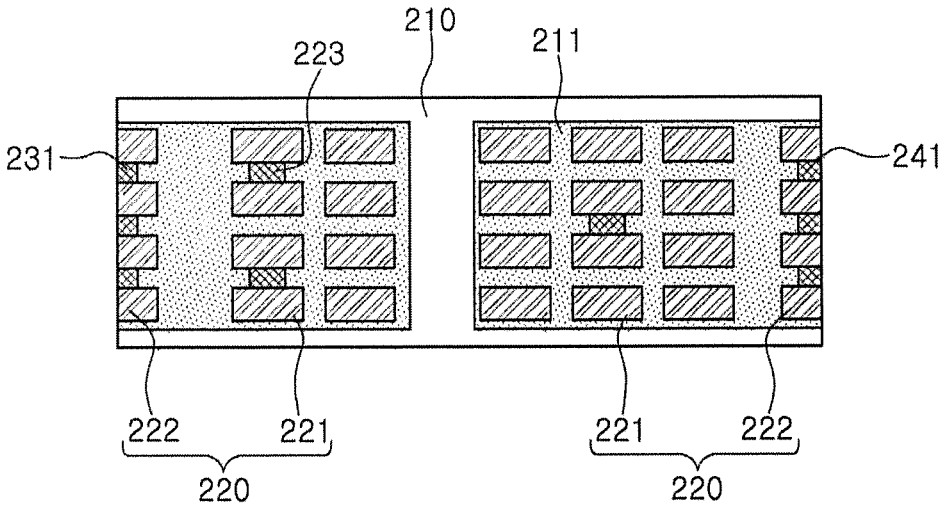

Then, as illustrated in FIG. 14, the connection patterns 222 and the connection electrodes 231 and 241 at the longitudinally opposite ends may be exposed by removing the core part 210 and the insulating layers 211. The core part 210 and the insulating layers 211 may be removed using a desired related art polishing process. However, when the connection patterns 222 and the connection electrodes 231 and 241 are formed exposed, the polishing process may be omitted.

Figure 15:
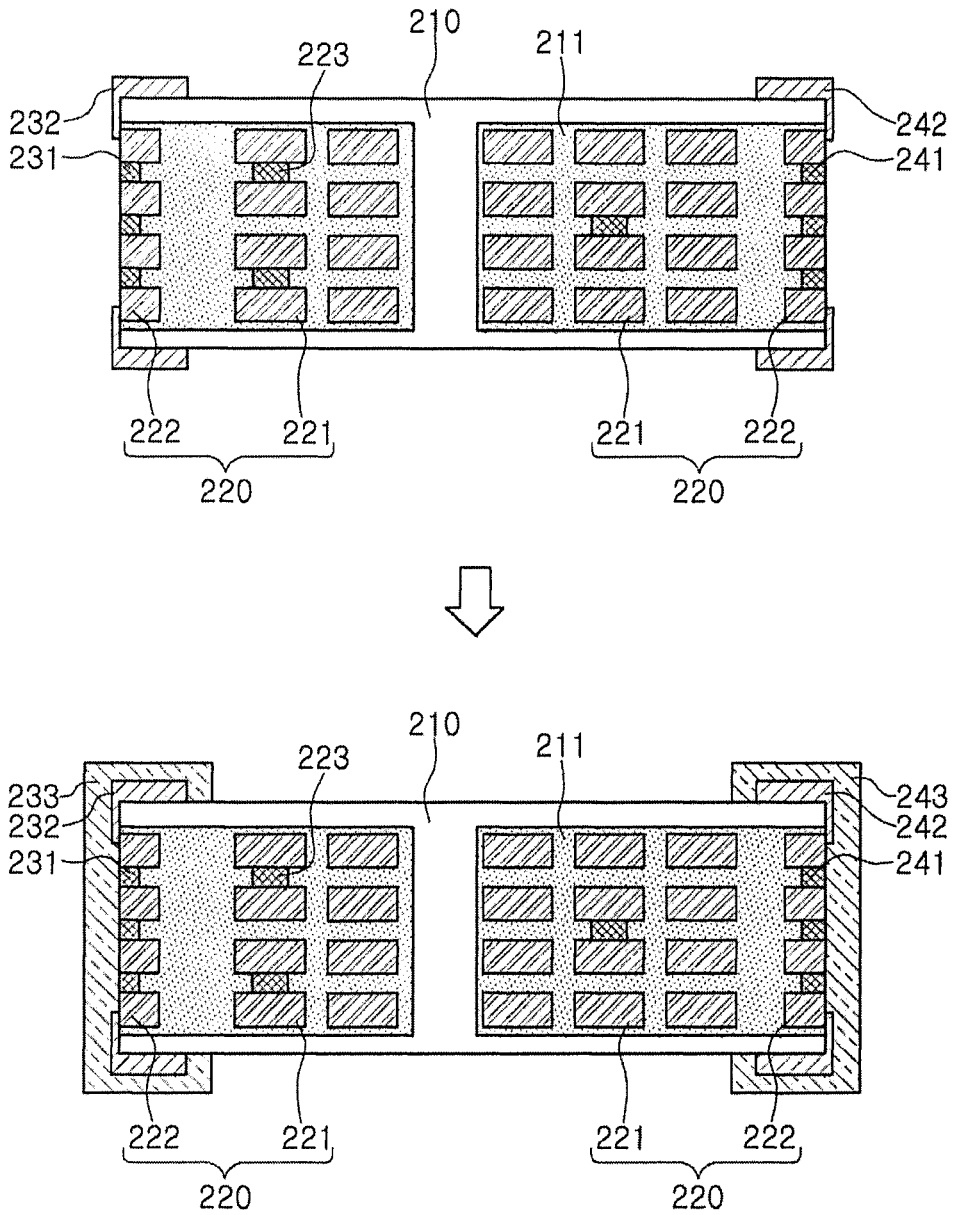

Then, as illustrated in FIG. 15, flexible electrodes 232 and 242 including an insulating resin, conductive particles, and the like, may be formed. The structure and placement of the flexible electrodes 232 and 242 may be similar to that of the flexible electrodes 132 and 142, and a discussion thereof is omitted for the sake of brevity. Then, external electrodes 233 and 243 may be formed at least partially enclosing or otherwise covering the connection electrodes 231 and 241, respectively. In this case, the external electrodes 233 and 243 may be in direct contact with the connection patterns 222 and the connection electrodes 231 and 241, respectively. In the present exemplary embodiment, a plating process does not need to be performed in order to form the connection electrodes 231 and 241, and the connection electrodes 231 and 241 may be formed by exposing the connection electrodes 231 and 241 formed in the prior steps. Thus, process efficiency may thus be improved.

As set forth above, when the coil electronic component 100 according to the exemplary embodiment in the present disclosure is used, electrical characteristics such as a DC resistance may be improved, and such a coil electronic component may be effectively manufactured by a collective stacking method discussed above.

While exemplary embodiments have been shown and described above, it will be apparent to those skilled in the art that modifications and variations could be made without departing from the scope of the present invention as defined by the appended claims.

What is claimed is:

1. A coil electronic component, comprising:

a body having a plurality of coil layers including coil patterns and connection patterns, the coil patterns arranged between the connection patterns in a longitudinal direction, and the connection patterns being at least partially exposed from the body;

connection electrodes connecting the connection patterns disposed in different coil layers of the plurality of coil layers with each other; and external electrodes connected to the connection electrodes and at least partially enclosing the connection electrodes, wherein the connection electrodes, each of which connects two or more of the connection patterns to each other, are disposed outside respective outermost portions of the body in the longitudinal direction.

2. The coil electronic component of claim 1, wherein the plurality of coil layers includes at least two connection patterns.

3. The coil electronic component of claim 2, wherein a coil pattern of an uppermost coil layer of the plurality of coil layers and a coil pattern of a lowermost coil layer of the plurality of coil layers are connected to one of the at least two connection patterns.

4. The coil electronic component of claim 3, wherein the external electrodes include first and second external electrodes having opposite polarities, and a connection pattern of the uppermost coil layer is connected to the first external electrode and a connection pattern of the lowermost coil layer is connected to the second external electrode.

5. The coil electronic component of claim 4, wherein the plurality of coil layers includes at least one intermediate coil layer disposed between the uppermost coil layer and the lowermost coil layer, and a coil pattern of the intermediate coil layer and the connection patterns are disconnected.

6. The coil electronic component of claim 2, wherein the at least two connection patterns are disposed opposite each other.

7. The coil electronic component of claim 1, wherein the connection electrodes at least partially cover side surfaces of the connection patterns.

8. The coil electronic component of claim 7, wherein the connection electrodes are pre-plating patterns.

9. The coil electronic component of claim 1, wherein the connection electrodes are conductive vias disposed between the connection patterns formed on the different coil layers, and wherein the external electrodes directly contact the connection patterns.

10. The coil electronic component of claim 1, further comprising flexible electrodes on upper and lower portions of the connection electrodes and covered by the external electrodes.

11. The coil electronic component of claim 10, wherein the flexible electrodes include at least one of an insulating resin and conductive particles.

12. The coil electronic component of claim 1, further comprising insulating layers at least partially enclosing the coil patterns and the connection patterns.

13. The coil electronic component of claim 12, further comprising a core part in a through hole defined in the insulating layers, the core part including a magnetic material.

14. The coil electronic component of claim 13, wherein the core part at least partially covers upper and lower portions of the plurality of coil layers.

15. The coil electronic component of claim 1, further comprising conductive vias connecting the coil patterns on different layers with each other.

16. The coil electronic component of claim 1, wherein each external electrode includes a multilayer structure.

17. The coil electronic component of claim 16, wherein the multilayer structure of each external electrode includes a plurality of plating layers.

18. The coil electronic component of claim 1, wherein each of the connection electrodes extends in a stacking direction of the plurality of coil layers as a single body.

19. The coil electronic component of claim 1, wherein a thickness of each of the connection electrodes is maximal at a center portion thereof and is decreased toward end portions thereof.

20. A coil electronic component, comprising:

a body having a plurality of coil layers including coil patterns and connection patterns, the coil patterns arranged between the connection patterns, and the connection patterns being at least partially exposed from the body;

connection electrodes connecting the connection patterns disposed in different coil layers of the plurality of coil layers with each other;

external electrodes connected to the connection electrodes and at least partially enclosing the connection electrodes; and flexible electrodes disposed along end portions of the connection electrodes and covered by the external electrodes, respectively, wherein the flexible electrodes overlap only a part of the respective connection electrodes.

* * * * *